US011673189B2

(12) United States Patent
Adriaens et al.

(10) Patent No.: US 11,673,189 B2
(45) Date of Patent: Jun. 13, 2023

(54) METHOD AND DEVICE FOR CASTING A ROTOR OF A COMPRESSOR, VACUUM PUMP AND/OR EXPANDER DEVICE WITH A LONGITUDINAL AXIS

(71) Applicant: ATLAS COPCO AIRPOWER, NAAMLOZE VENNOOTSCHAP, Wilrijk (BE)

(72) Inventors: Victor Adriaens, Wilrijk (BE); Jun Wang, Wuxi (CN); Jan De Backer, Reet (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 91 days.

(21) Appl. No.: 17/431,514

(22) PCT Filed: Mar. 3, 2020

(86) PCT No.: PCT/IB2020/051790
§ 371 (c)(1),
(2) Date: Aug. 17, 2021

(87) PCT Pub. No.: WO2020/208436
PCT Pub. Date: Oct. 15, 2020

(65) Prior Publication Data

US 2022/0143689 A1 May 12, 2022

(30) Foreign Application Priority Data

Apr. 9, 2019 (BE) ..... 2019/5229

(51) Int. Cl.
*B22C 9/02* (2006.01)
*B22C 9/22* (2006.01)
(Continued)

(52) U.S. Cl.
CPC ..... *B22D 45/00* (2013.01); *B22C 9/02* (2013.01); *B22C 9/22* (2013.01); *B22D 25/02* (2013.01)

(58) Field of Classification Search
CPC ..... B22C 9/02; B22C 9/22; B22D 25/02
See application file for complete search history.

(56) References Cited

U.S. PATENT DOCUMENTS

| | | | | |
|---|---|---|---|---|
| 9,895,743 | B2 * | 2/2018 | Rathner | B22D 41/04 |
| 2008/0023170 | A1 | 1/2008 | Farkas et al. | |
| 2015/0231692 | A1 * | 8/2015 | Tsutsumi | B22C 9/02 164/349 |

FOREIGN PATENT DOCUMENTS

| | | | |
|---|---|---|---|
| CN | 104096806 | A | 10/2014 |
| CN | 211915497 | U | 11/2020 |

(Continued)

OTHER PUBLICATIONS

International Search Report for PCT/IB2020/051790 dated May 27, 2020 (PCT/ISA/210).

(Continued)

*Primary Examiner* — Kevin E Yoon
(74) *Attorney, Agent, or Firm* — Sughrue Mion, PLLC

(57) ABSTRACT

The device according to any of the preceding claims 13 to 19, characterized in that the device is further configured to carry out a method comprising the step of positioning the green sand mold (3), wherein the device is provided with levelling means configured to hold an upper side of the green sand mold (3) during step c in a parallel position in relation to a gravitationally horizontal plane.

20 Claims, 6 Drawing Sheets

(51) Int. Cl.
*B22D 25/02* (2006.01)
*B22D 45/00* (2006.01)

(56) References Cited

FOREIGN PATENT DOCUMENTS

| | | | | |
|---|---|---|---|---|
| DE | 20 2009 012 656 | U1 | 3/2010 | |
| GB | 2 094 897 | A | 9/1982 | |
| WO | WO-9603237 | A1 * | 2/1996 | ..... B22C 9/22 |

OTHER PUBLICATIONS

Written Opinion for the International Searching Authority for PCT/IB2020/051790 dated May 27, 2020 (PCT/ISA/237).

* cited by examiner

METHOD AND DEVICE FOR CASTING A ROTOR OF A COMPRESSOR, VACUUM PUMP AND/OR EXPANDER DEVICE WITH A LONGITUDINAL AXIS

CROSS REFERENCE TO RELATED APPLICATIONS

This application is a National Stage of International Application No. National Stage Entry of PCT/IB2020/051790 filed Mar. 3, 2020, claiming priority based on Belgian Patent Application No. 2019/5229 filed Apr. 9, 2019.

BACKGROUND OF THE INVENTION

Field of the Invention

The invention relates to a method and device for casting a rotor with a longitudinal axis for a compressor, vacuum pump and/or expander device.

A 'longitudinal axis' means a straight or substantially straight axis around which the rotor or at least a substantial part of the rotor is axisymmetrical.

More specifically, the invention relates to a method and device for casting a large-scale rotor with a longitudinal axis for a compressor, vacuum pump and/or expander device.

A 'large-scale rotor' means a rotor with a dimension, according to the longitudinal axis, of typically at least 650 millimeters.

Background

There are state of the art casting processes known wherein molten casting material, typically grey or ductile cast iron, is casted into a mold cavity of a core in a sand mold through a casting channel, and by filling the mold cavity in the core with this molten casting material, a casting is formed through a surface of the mold cavity.

The mold cavity in the core is at one or more positions where the molten casting material should solidify the last during molding, externally provided with a riser in the sand mold.

The riser hereby serves as a reservoir for excess molten casting material after the mold cavity has been filled completely or almost completely with casting material, from which reservoir molten casting material can be drawn back into the mold cavity by shrinking of the casting during the solidification of this casting.

In this way, formation of holes in the casting that are not filled with casting material due to the shrinking of the casting during solidification is avoided.

The location of one or more positions where a riser is provided is critical for either reducing the number and/or volume, or avoiding of these holes in the casting that are not filled with casting material.

Large-scale castings with a longitudinal axis are typically cast horizontally.

A 'large-scale casting' means a casting with a dimension, according to the longitudinal axis, of typically at least 650 millimeters.

'Horizontal casting' means that a longitudinal axis of the mold cavity, which coincides with the longitudinal axis of the casting after the casting has been formed in the core by completely or almost completely filling the mold cavity with casting material, extends in a gravitationally horizontal plane.

A 'gravitationally horizontal plane' means a plane perpendicular to a direction in which a principal force of gravity, typically the gravitational attraction force of the earth, is exerted on the casting material. In other words, a 'gravitationally horizontal plane' means a plane that is level oriented.

However, the rotor of a compressor, vacuum pump and/or expander device is difficult or impossible to be cast horizontally.

Due to an often more or less complex geometry of such a rotor, for example a screw rotor with helical lobes, it is difficult or impossible to reduce and/or avoid the formation of holes in the casting that are not filled with casting material with a limited number of risers.

In addition, impurities that would be present in the molten casting material and/or inhomogeneities that would arise in the mold cavity when the casting material solidifies will not be able to be removed from the mold cavity through flotation on still molten casting material in the mold cavity. For example, for rotors cast in GGG45 ductile iron, the aforementioned inhomogeneities occur mainly in the form of graphite flotation.

When these impurities and/or inhomogeneities become trapped in the material of the formed rotor as final product of the casting process during solidification of the casting material in the mold cavity, they cause an uneven distribution of weight and consequently an imbalance around the longitudinal axis of this formed rotor. The presence of impurities and/or inhomogeneities in the material of the formed rotor can also have a negative influence on surface quality and/or mechanical properties of the formed rotor, such as strength and/or stiffness.

For the aforementioned reasons, the quality of a horizontally cast rotor may not meet certain predetermined requirements and/or an external surface of this rotor may need to be processed to a certain depth after the casting process, which increases the post-processing costs of the formed rotor.

Due to the aforementioned disadvantages of horizontal casting of rotors of a compressor, vacuum pump and/or expander device, these rotors are usually cast vertically.

'Vertical casting' means that a longitudinal axis of the mold cavity, which coincides with the longitudinal axis of the casting after the casting has been formed in the core by completely or almost completely filling the mold cavity with casting material, extends in a gravitationally vertical direction.

A 'gravitationally vertical direction' means a direction parallel to a direction in which a principal force of gravity, typically the gravitational attraction force of the earth, is exerted on the casting material. In other words, a 'gravitationally vertical direction' means a direction perpendicular to a level-oriented plane.

The vertical casting of rotors imposes certain restrictions with regard to a height of the sand mold according to a gravitationally vertical direction and/or with regard to the material from which the sand mold is made.

Because of the vertical casting, the mold should not only accommodate the core for the rotor to be cast according to this height, but also a riser which extends above this core in a gravitationally vertical direction and in which a certain pressure height must be guaranteed.

Compared to the horizontal casting of a large-scale rotor, the vertical casting of a large-scale rotor of the same dimensions involves a higher static pressure and impact of the molten casting material on the core and, as such, indirectly on the sand mold, since the height of the core according to a gravitationally vertical direction is greater when casting vertically.

For this reason, in the current state of the art, for the vertical casting of large-scale rotors use is made of a sand mold made from resin bonded mold sand, such as furan sand.

However, the production of resin bonded mold sand has a number of limitations.

A first limitation is the low efficiency with which a resin bonded mold sand can be produced, since a resin needs a certain curing time after application to sand.

A second limitation is a higher production cost of resin bonded mold sand compared to a non-resin bonded, but clay bonded green sand, due to the use of resin with a curing agent. As a result, the production cost for resin bonded mold sand is typically 15 to 20% higher than the production cost for non-resin bonded green sand.

Green sand molds are made from 'wet sand'. This wet sand includes, in addition to sand, typically quartz sand, also water and clay as a binding agent, such as bentonite or another organic clay.

Traditionally, castings are produced in green sand molds using a semi-automatic jolt squeeze molding machine.

Such a semi-automatic jolt squeeze molding machine implies the disadvantage of a number of necessary manual operations and an associated operational uncertainty. For example, a green sand mold that is mechanically less strong and stable than a resin bonded sand mold can be damaged during these manual operations, which makes it difficult to achieve and/or ensure a predetermined quality level for the rotor as final product.

The use of an automatic mold line for casting a rotor into a green sand mold has the advantages of higher production efficiency, absence of manual operations and consequently a more stable quality level for the rotor as a final product than when using a semi-automatic jolt squeeze molding machine.

However, when vertically casting a rotor, such an automatic mold line is still limited with regard to the height of the formed rotor up to a typical maximum height of 650 millimeters, in order to limit the static pressure and/or impact of molten casting material in the green sand mold during the casting of the rotor and thus protect the green sand mold against collapse under this static pressure and/or impact.

Vertical casting of rotors with a dimension according to their longitudinal axis typically larger than 650 millimeters is therefore not possible with the use of a green sand mold on an automatic mold line.

This invention aims at solving at least one of the aforementioned disadvantages and/or other disadvantages.

More specifically, the aim of this invention is to allow the casting of large-scale rotors, i.e. rotors with a dimension according to their longitudinal axis typically larger than 650 millimeters, in a green sand mold.

SUMMARY OF THE INVENTION

The present invention relates to a method for casting a rotor with a longitudinal axis for a compressor, vacuum pump and/or expander device, wherein the method comprises the following steps:

a. the formation of a green sand mold with a cavity, wherein the cavity is configured to contain a core with a mold cavity, wherein a surface of the mold cavity is configured to form the rotor in such a way that a longitudinal axis of the mold cavity coincides with the longitudinal axis of the rotor formed in the mold cavity;
b. inserting the core into the cavity; and
c. pouring molten casting material into the mold cavity through an inlet of the core, and filling the mold cavity completely or almost completely with casting material to form the rotor, characterized in that the cavity is held in a tilted position by tilting means during step c wherein the longitudinal axis of the mold cavity is tilted in relation to a gravitationally vertical direction and in relation to a gravitationally horizontal plane.

The term 'tilted' is in this context synonymous with 'non parallel'.

An advantage of the method according to this invention is that, when the cavity is in the aforementioned tilted position, the static pressure and/or impact of the casting material of the formed rotor on the surface of the mold cavity in the core is smaller than when a same rotor is cast vertically. At the same time, impurities and/or inhomogeneities in the molten casting material in the mold cavity can be concentrated by flotation on this molten casting material to a greater extent than when a same rotor is casted horizontally, and may be removed from the mold cavity via a riser, which improves the quality characteristics of the formed rotor as final product.

This allows large-scale rotors of a compressor, vacuum pump and/or expander device, i.e. rotors with a dimension according to their longitudinal axis typically greater than 650 millimeters, to be cast using a green sand mold, where these rotors meet predefined quality requirements in terms of surface quality and/or mechanical properties and/or a balanced weight balance around the longitudinal axis.

In a preferred embodiment of the method according to the invention, during step c, the longitudinal axis of the mold cavity is tilted in relation to a gravitationally horizontal plane over an angle of at least 5°, preferably at least 10°, more preferably at least 15°, and even more preferably at least 20°.

By setting a minimum angle over which the longitudinal axis of the mold cavity is tilted during step c, the risk is reduced and/or eliminated that impurities and/or inhomogeneities in the molten casting material cannot be concentrated and removed by flotation, but remain as contamination in the formed rotor as final product of the casting process.

In a preferred embodiment of the method according to the invention, during step c, the longitudinal axis of the mold cavity is tilted in relation to a gravitationally horizontal plane over an angle of at most 45°, preferably at most 40°, more preferably at most 35°, and even more preferably at most 30°.

By setting a maximum angle over which the longitudinal axis of the mold cavity is tilted during step c, large-scale rotors can be cast using a green sand mold with a height of up to 650 millimeters in relation to a gravitationally vertical direction, as the risk of the green sand mold collapsing under the static pressure and/or impact of the molten casting material in the mold cavity is reduced and/or eliminated.

Preferably, in the method according to the invention, the cavity is hold in the tilted position during step c in such a way that the mold cavity extends upwards in relation to the gravitationally vertical direction with respect to the inlet.

The advantage of such a positioning of the mold cavity in relation to the inlet is that during step c, the inlet will be below an upper surface of molten casting material in the mold cavity. As a result, there is only minimal disturbance of this upper surface by newly molten casting material being casted through the inlet into the mold cavity, which ensures optimal flotation of impurities and/or inhomogeneities on the molten casting material in the mold cavity.

In a further preferable embodiment of the method according to the invention, the angle over which the longitudinal axis of the mold cavity is tilted in relation to a gravitationally vertical direction and in relation to a gravitationally horizontal plane is fixed during step c by blocking means.

This has the advantage that shocks to the green sand mold during the casting of the rotor are reduced to a minimum, such that the risk of damage to the green sand mold during casting is also reduced.

Preferably, in the method according to the invention during step b, the cavity is hold in the aforementioned tilted position.

In this way the green sand mold can be used in step c, after having placed the core in step b, without having to change the tilted position of the cavity by tilting the green sand mold. This reduces the risk of damaging the green sand mold during the transition from step b to step c, as shocks to the green sand mold, that may be associated with the tilting, are avoided. In addition, the time to carry out the method can be reduced, as in this way no time needs to be spent on tilting the green sand mold between step b and step c. In addition, the method is simplified in this way, which facilitates automation of the method.

According to an even more preferable characteristic of this embodiment of the method according to the invention, during step a the cavity is formed in the aforementioned tilted position in the green sand mold.

This allows the tilted position of the cavity to remain constant throughout the entire method according to the invention without the need to, in some manner, tilt the green sand mold during the method, which reduces the risk of damage to the green sand mold due to shocks during the transition from step a to step b, and facilitates automation of the method.

Preferably, the green sand mold with the cavity is formed during step a by casting and pressing green sand on a mold plate, which is provided with a protruding pattern configured to form the cavity in the green sand mold.

The use of a mold plate with a pattern makes it possible to form the cavity in the green sand mold in a reproducible manner. In addition, the use of a mold plate makes it possible to form the cavity in a (semi-)automatic way.

In a preferred embodiment of the method according to the invention in which, during step a, the cavity is formed in the aforementioned tilted position in the green sand mold and the green sand mold with the cavity is formed by casting and pressing green sand on the aforementioned mold plate with the aforementioned protruding pattern, the mold plate comprises several flat plates tilted in relation to one another, whereby at least one of these flat plates is provided with the aforementioned protruding pattern and tilted in relation to a gravitationally horizontal plane at an angle corresponding to the aforementioned tilted position.

In this way, only part of the mold plate is used to form the cavity in the green sand mold in the tilted position, while other parts of the mold plate can be held in a more conventional position parallel to a gravitationally horizontal plane.

As such, the cavity can be formed and casted in a tilted position, while the green sand mold around this cavity can be held in a horizontal position. As a result, the potentially heavy green sand mold does not need to be tilted during the method. In addition, this ensures that a casting channel and a riser in the green sand mold can always be oriented according to a gravitationally vertical direction. In addition, the casting channel does not need to be extended if the green sand mold is tilted more in relation to a gravitationally horizontal plane, which would be the case if the whole green sand mold had to be tilted along with the cavity.

As a preferred embodiment, the method according to the invention is carried out on an automatic mold line.

This reduces the risk of damage to the green sand mold and/or errors in the execution of the method as a result of manual operations on the green sand mold.

Preferably, the molten casting material is filtered through a metal filter before step c.

Filtering the molten casting material before step c has the advantages that

- impurities are removed from the molten casting material, resulting in a better surface quality and/or mechanical properties and consequently a lower rejection rate of the formed rotors; and
- the need for a trap for metal slags and/or other equipment to supply the inlet of the green sand mold with a laminar flow of pure molten casting material can be eliminated.

In a final preferred embodiment of the invention, the method further includes the step of positioning the green sand mold, whereby an upper side of the green sand mold is held parallel to a gravitationally horizontal plane during step c by levelling means.

The advantage of the horizontal orientation of the upper side of the green sand mold, while holding the cavity in the tilted position, is that a length of the casting channel and/or an orientation of a connection between the riser and an exterior of the green sand mold is almost fixed regardless of the extent to which the cavity is tilted.

If the green sand mold is to be tilted along with the cavity, the length of the casting channel should be extended when the longitudinal axis of the mold cavity is inclined at a greater angle in relation to a gravitationally horizontal plane. In addition, the connection between the riser and the exterior of the green sand mold may no longer be oriented parallel to a gravitationally vertical direction when the upper side of the green sand mold is in a tilted position in relation to a gravitationally horizontal plane, which limits the pressure height to be achieved in the riser.

The invention also concerns a device for casting a rotor of a compressor, vacuum pump and/or expander device with a longitudinal axis, wherein the device has been configured to perform a method that comprises the following steps:

a. the formation of a green sand mold with a cavity, wherein the cavity is configured to contain a core with a mold cavity, wherein a surface of the mold cavity is configured to form the rotor in such a way that a longitudinal axis of the mold cavity coincides with the longitudinal axis of the rotor formed in the mold cavity;
b. inserting the core into the cavity; and
c. pouring molten casting material into the mold cavity through an inlet of the core, and filling the mold cavity completely or almost completely with casting material to form the rotor, characterized in that the cavity is held in a tilted position by tilting means during step c wherein the longitudinal axis of the mold cavity is tilted in relation to a gravitationally vertical direction and in relation to a gravitationally horizontal plane.

The advantages of such a device are obviously similar to those of the method according to the invention.

BRIEF DESCRIPTION OF THE DRAWINGS

To better demonstrate the characteristics of the invention, the following describes, by way of example without any restrictive character, a number of preferred embodiments of the method and the device according to the invention, with reference to the accompanying drawings, in which.

DETAILED DESCRIPTION OF THE INVENTION

Figure 1A:
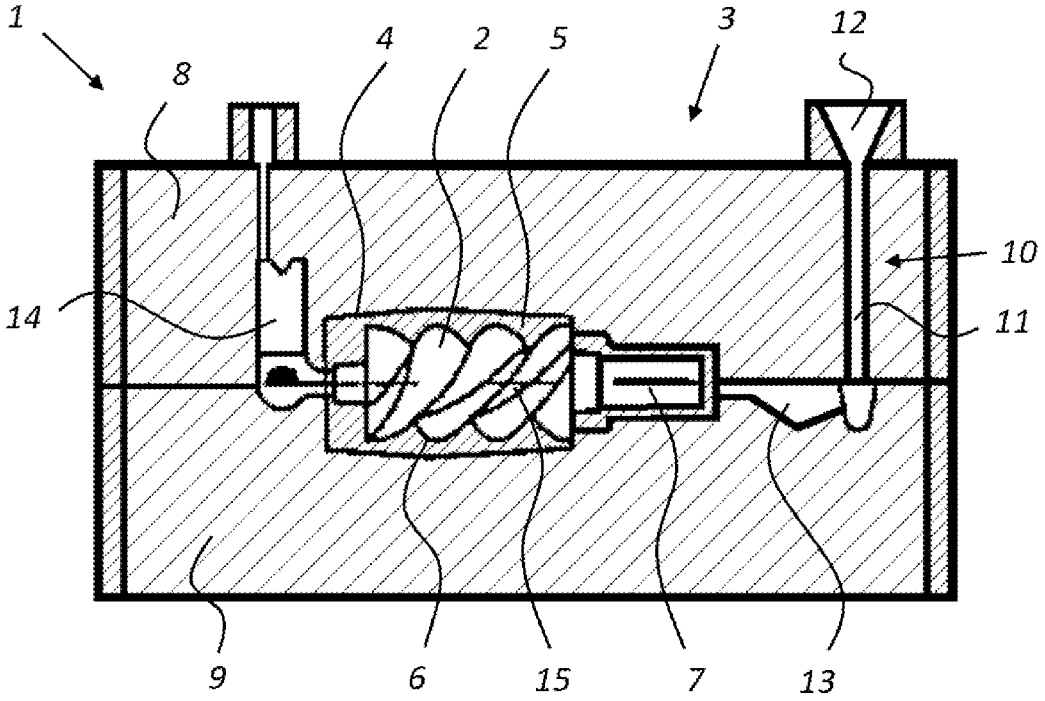
FIG. 1*a* shows a conventional device for horizontal casting of a rotor for a compressor, vacuum pump and/or expander device.

A conventional device 1 for horizontal casting of a rotor 2 of a compressor, vacuum pump and/or expander device in a green sand mold 3 is shown in FIG. 1*a*.

In this green sand mold 3 a cavity 4 is formed and this cavity 4 is configured to contain a core 5 with a mold cavity.

When horizontally casting the rotor 2, molten casting material is casted through an inlet 7 of the core 5 into the mold cavity 6, and the mold cavity 6 is filled completely or almost completely with casting material to form rotor 2 in the mold cavity 6.

The green sand mold 3 and or core 5 can comprise several separate parts. Typically, green sand mold 3 consists of two halves 8, 9, with the cavity 4 extending along both sides of a sub plane between these two halves 8, 9.

The green sand mold 3 is provided with a casting device 10 which includes a casting channel 11 with a casting funnel 12 on the outside of the green sand mold 3 and a feed chute 13 on the inlet 7 of the core 5, along which casting device 10 can direct molten casting material to and into the inlet 7 of the core 5.

The green sand mold 3 is also provided with a riser 14, along which molten casting material can leave the mold cavity 6, and where a reservoir of molten casting material can form when the mold cavity 6 is completely or almost completely filled with casting material. When the rotor 2 solidifies in the mold cavity 6, the rotor 2 will shrink, as a result of which molten casting material from the reservoir of the riser 14 is sucked back to and into the mold cavity 6. In this way, the formation of holes in the cast rotor 2 which are not filled with casting material during the solidification of the rotor 2 is avoided or at least reduced.

The term 'horizontal casting' implies that when the mold cavity 6 is completely or almost completely filled with casting material and consequently the rotor 2 is formed in the mold cavity 6, the longitudinal axis 15 of the formed rotor 2 lies in a gravitationally horizontal plane.

Due to the more or less complex geometry of a rotor of a compressor, vacuum pump and/or expander device and the positioning of a single riser 14 in FIG. 1*a*, it can clearly be deduced that impurities and/or inhomogeneities can only to a limited extent be removed from the mold cavity 6 by flotation on the upper surface of molten casting material via riser 14. A large part of these impurities and/or inhomogeneities will end up in a gravitationally vertical direction in relation to the upper part of the mold cavity 6, where they will be trapped as contamination in the formed rotor 2 during solidification. This contamination can have a negative influence on surface quality and/or mechanical properties and/or a balanced distribution of weight around the longitudinal axis 15 of the formed rotor 2 as final product.

Figure 1B:
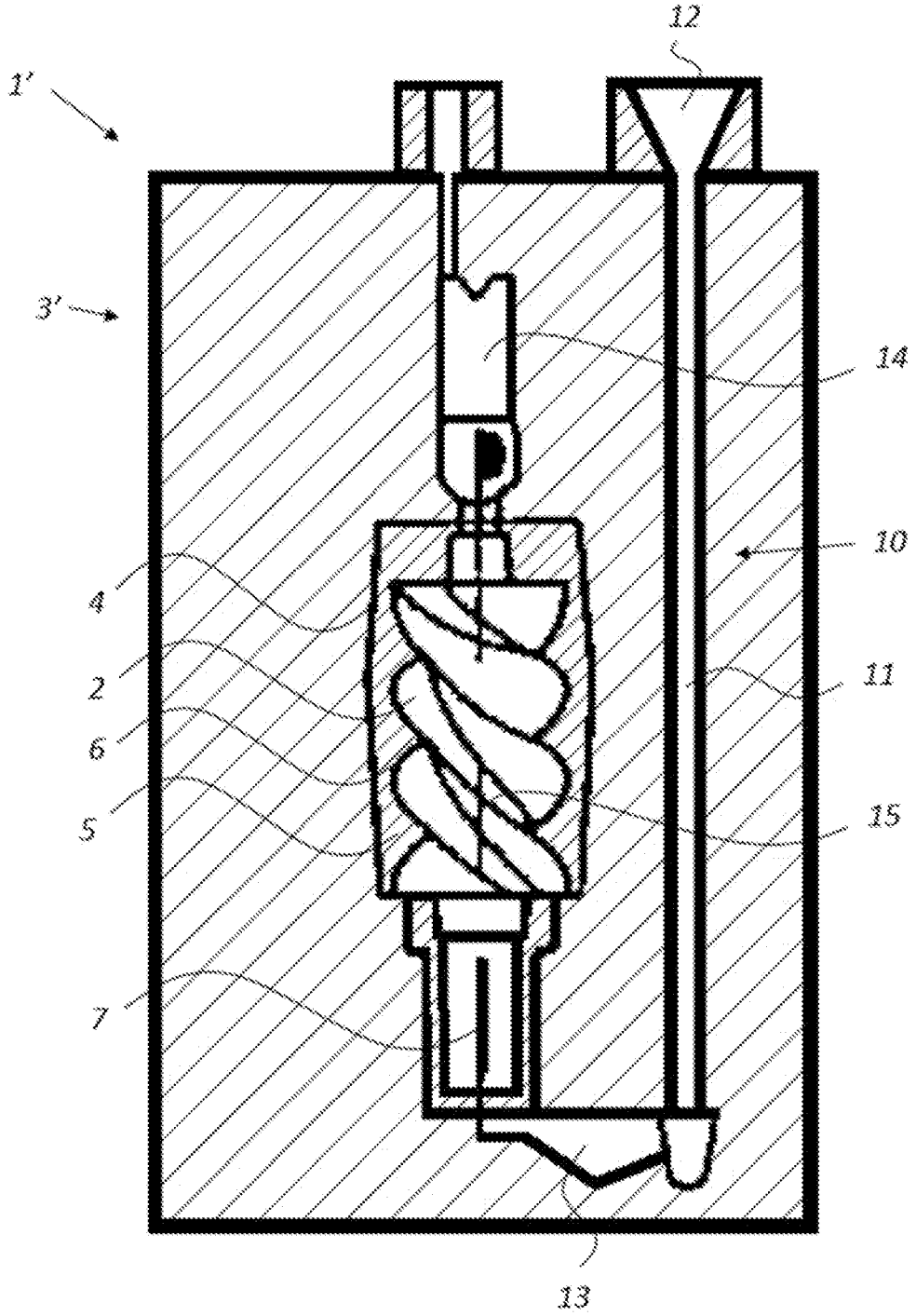
FIG. 1*b* shows a conventional device for vertical casting of a rotor for a compressor, vacuum pump and/or expander device.

A conventional device 1 for horizontal casting of a rotor 2 of a compressor, vacuum pump and/or expander device in a green sand mold 3' is shown in FIG. 1*b*.

In addition to core 5, the resin bonded sand mold 3' in the direction of the longitudinal axis 15 of the formed rotor 2 in the mold cavity 6 should now also include riser 14 according to its longest dimension, which implies a loss of useful space for core 5 in the resin bonded sand mold 3' and consequently a waste of sand in the resin bonded sand mold 3'.

In addition, in this case a required length of the casting channel 11 in the resin bonded sand mold 3' is greater than when casting a rotor 2 horizontally with the same dimensions as shown in FIG. 1*a*.

Figure 2A:
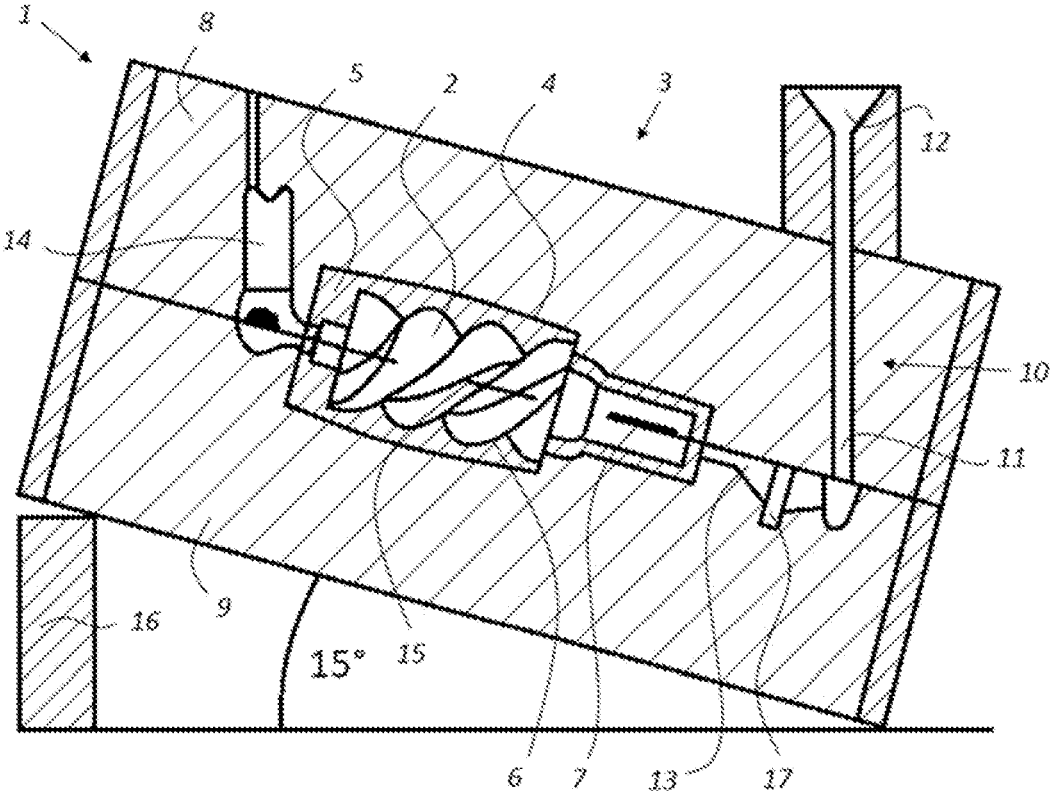
FIG. 2*a* shows a device according to the invention for casting a rotor of a compressor, vacuum pump and/or expander device with a longitudinal axis.

FIG. 2*a* shows an embodiment of the device according to the invention.

The green sand mold 3 is hold in a tilted position during the casting of the rotor 2 together with a core 5 in cavity 4 by tilting means 16, wherein the longitudinal axis 15 of the finally formed rotor 2 is tiled in relation to a gravitationally vertical direction and in relation to a gravitationally horizontal plane. The mold cavity 6 extends upwards with respect to the inlet 7 in a gravitationally vertical direction.

Tilting means 16 is typically an elevating support on which the green sand mold 3 is placed along one of its sides, as shown in FIG. 2*a*, or a lifting device configured to lift the green sand mold 3 along one side. It is of course not excluded that the tilting means 16 consists of a sand mold 3 in which a ground plane of this sand mold 3 is parallel to a gravitationally horizontal plane and the sub plane between the halves 8, 9 is tilted in relation to a gravitationally horizontal plane.

In this case, the sub plane between halves 8, 9 of the green sand mold 3 and the core 5 are tilted in relation to a gravitationally horizontal plane at an angle of 15°.

This angle can be fixed by blocking means, which in this case coincide with the tilting means 16.

The feed chute 13 can optionally be fitted with a metal filter 17. This metal filter 17 is typically made of a ceramic foam. The use of a metal filter 17 just before the inlet 7 has the following advantages:

- the reduction of a turbulent flow of molten casting material coming from the casting channel 11 before it is fed into the inlet 7 of the core 5, allowing a homogeneous filling of the mold cavity 6, thus reducing or even preventing the formation of inhomogeneities and/or erosion in the mold cavity 6;
- the removal of impurities in the molten casting material coming from the casting channel 11, which results in a better surface quality and/or mechanical properties and consequently a lower rejection rate of the formed rotors 2.
- simplifying the casting device 10, since a trap for metal slag or a change in the feed chute 13 is no longer required to provide the inlet to core 5 with a laminar flow of pure molten casting material.

Figure 2B:
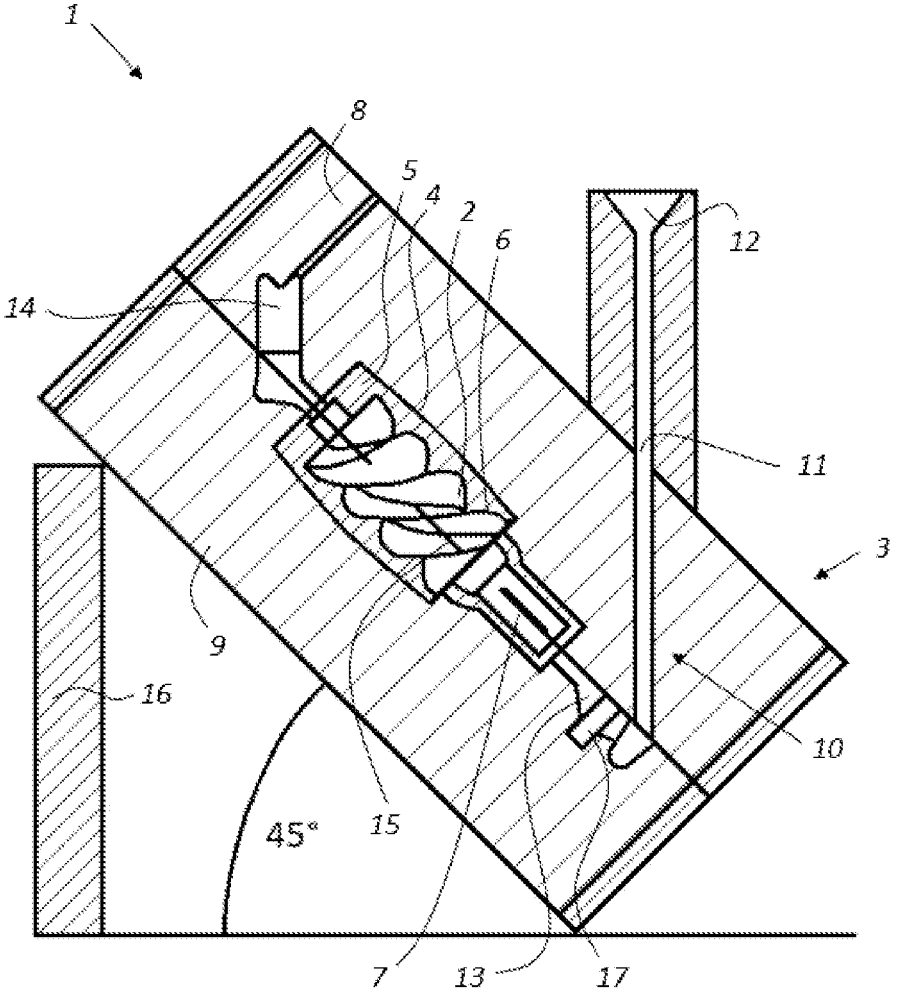
FIG. 2*b* shows a variant of the device in FIG. 2*a;*

FIG. 2*b* shows a variant of the device in FIG. 2*a*.

In this case, the sub plane between halves 8, 9 of the green sand mold 3 and the core 5 are tilted in relation to a gravitationally horizontal plane at an angle of 45°.

Comparison of the devices in FIGS. 2*a* and 2*b* clearly shows that a required length of the casting channel 11 must be greater when, during the casting of rotor 2, the angle at which the sub plane between halves 8, 9 of the green sand mold 3 and the core 5 are tilted in relation to a gravitationally horizontal plane is greater.

Furthermore, it is clear that from a certain value for this angle it is no longer possible to orient a connection between riser 14 and an exterior of green sand mold 3 in a gravitationally vertical direction, so that a maximum pressure height to be reached in a gravitationally vertical connection between riser 14 and the exterior of green sand mold 3 can inevitably not be reached.

With regard to the devices shown in FIGS. 2*a* and 2*b*, it cannot of course be excluded that during the casting of rotor 2, the green sand mold 3 and the core 5 are tilted in relation to a gravitationally horizontal plane at an angle with a different value, as long as the green sand mold 3 does not collapse under the static pressure and/or impact of the molten material in the mold cavity 6 and as long as impurities and/or inhomogeneities accumulated by flotation on the upper surface of molten casting material in the mold cavity 6 are removed from the mold cavity 6 via the riser 14.

Figure 3:
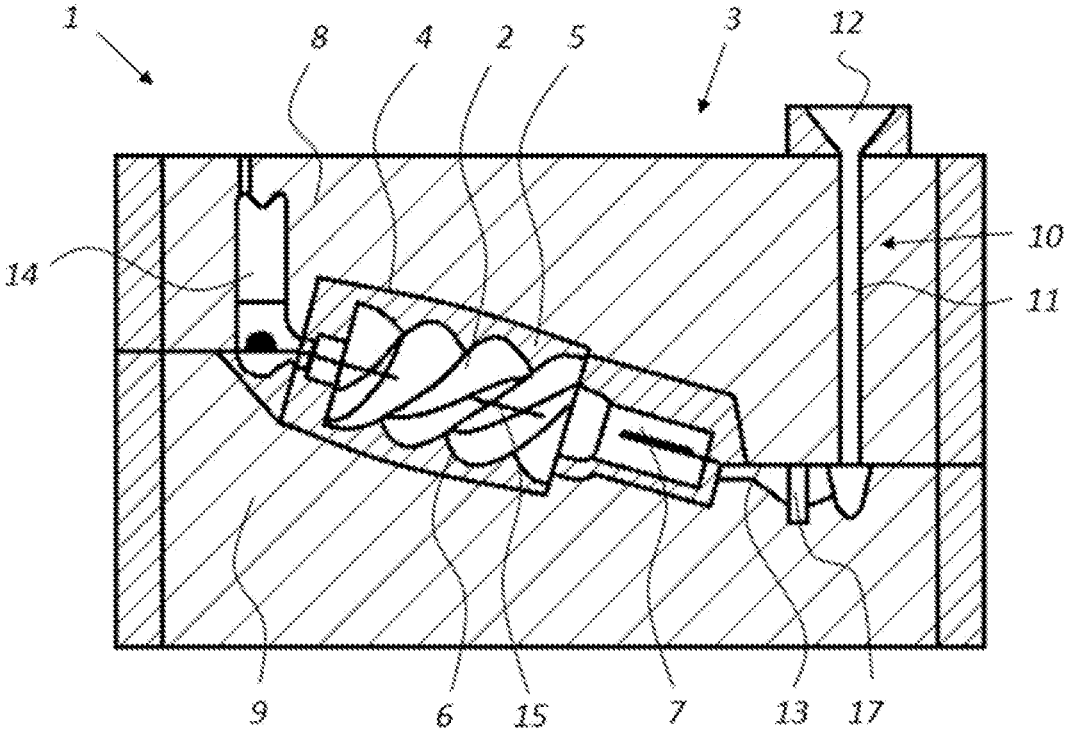
FIG. 3 shows a variant of the device in FIGS. 2*a* and 2*b;*

FIG. 3 shows a variant of the device in FIGS. 2*a* and 2*b*.

In this case, during the casting of rotor 2, only core 5 is held in the tilted position, while an upper side of green sand mold 3 remains horizontally oriented by levelling means in relation to a gravitationally horizontal plane.

In the simplest case, the levelling means is simply a correct orientation of an underside of green sand mold 3, in other words a side on which the green sand mold 3 rests. It is not excluded that the levelling means consists of an elevating support on one side of green sand mold 3 or a lifting device configured to lift the green sand mold 3 on one side.

In this device, the required length of the casting channel 11 is independent of the angle at which the core 5 is tilted in relation to a gravitationally horizontal plane.

In addition, the orientation of the connection between the riser 14 and the exterior of the green sand mold 3 can always be chosen according to a gravitationally vertical direction, so that the maximum pressure height to be reached in riser 14 can now be achieved.

Figure 4A:
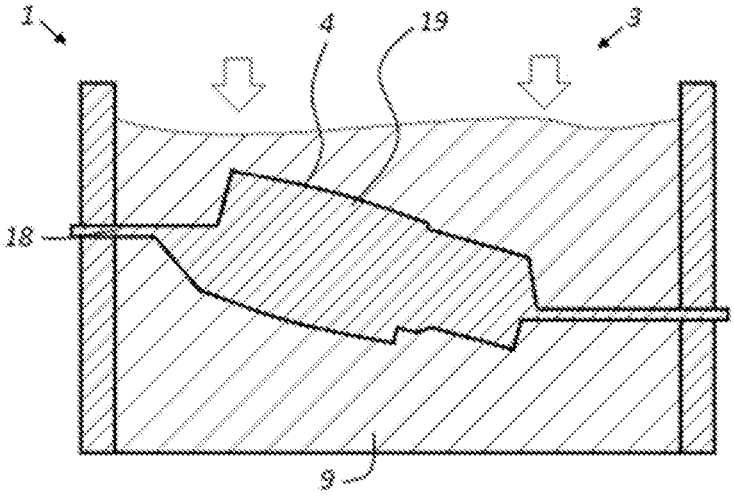
FIG. 4*a*-4*c* show a device according to the invention for casting a rotor of a compressor, vacuum pump and/or expander device with a longitudinal axis.
Figure 4B:
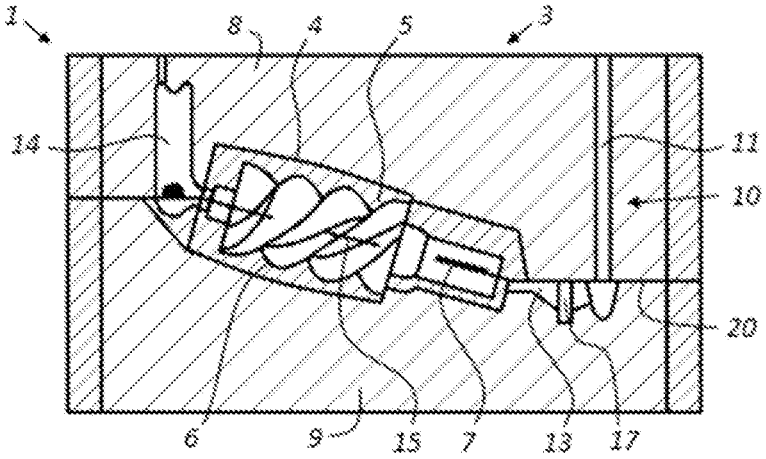
Figure 4C:
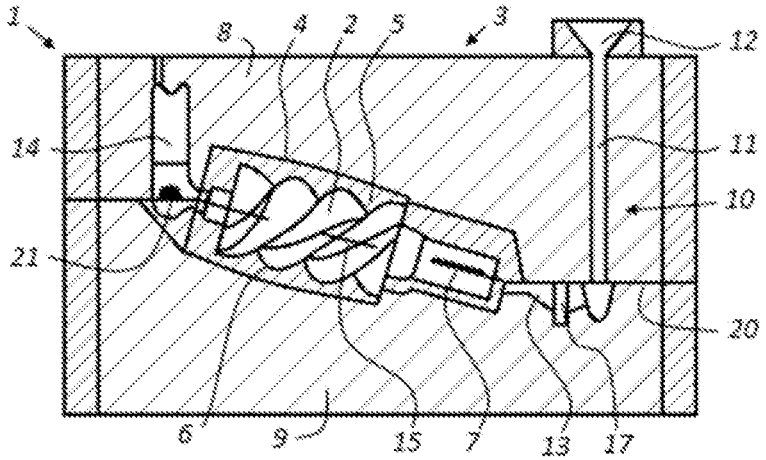

FIGS. 4*a*-4*c* illustrate a method for casting a rotor 2 of a compressor, vacuum pump and/or expander device.

In step a the cavity 4 is formed in the green sand mold 3, wherein the cavity 4 is configured to contain the core 5 with the mold cavity 6.

In this case, the cavity 4 is already formed in the tilted position during step a. The cavity 4 is formed in this step by casting and pressing a green sand on a mold plate 18, with the mold plate 18 having a protruding pattern 19 configured to form the cavity 4 in the green sand mold 3.

The mold plate 18 in this case has a geometry that includes several flat plates tilted relative to each other. In this case, the cavity 4 is formed in green sand mold 3 by means of a protruding pattern 19 on at least one of these flat plates, with this flat plate tilted at an angle corresponding to the aforementioned tilted position of the cavity 4. The other flat plates of the mold plate 18 are configured to form the rest of the green sand mold 3 and are preferably largely parallel to a gravitationally horizontal plane. The geometry of mold plate 18 with flat plates tilted in relation to each other means that a sub plane 20 of the formed green sand mold 3 will not be flat in one direction but broken flat.

In the next step b, the core 5 with the mold cavity 6 is placed in the cavity 4.

During this step b, in this case also the casting channel 11, the feed chute 13 and the riser 14 are formed in green sand mold 3. The metal filter 17 is also placed in the feed chute 13.

However, it is not excluded that the forming of the casting channel 11, the feed chute 13 and the riser 14 in the green sand mold 3 and/or the installation of the metal filter 17 in the feed chute 13 already takes place during step a.

After forming the cavity 4 into the green sand mold 3 in step a and placing the core 5 into the cavity 4, in a subsequent step c the rotor 2 is cast and formed from molten casting material. To this end, in this step c, through an inlet 7 of the core, 5 molten casting material is casted into the mold cavity 6, and the mold cavity 6 is completely or almost completely filled with casting material to form the rotor 2.

Optionally, the core 5 can be provided with a second inlet 21 through which additional molten casting material can be guided to and into the mold cavity 6 during the solidification and shrinking of the formed rotor 2 in the mold cavity 6.

This invention is by no means limited to the embodiments described by way of example and shown in the drawings, but a method and device according to the invention for casting a rotor of a compressor, vacuum pump and/or expander device with a longitudinal axis can be realized in all kinds of variants without going beyond the scope of the invention.

The invention claimed is:

1. A method for casting a rotor (2) with a longitudinal axis (15) for a compressor, vacuum pump and/or expander device, wherein the method comprises the following steps:

a. the formation of a green sand mold (3) with a cavity (4), wherein the cavity (4) is configured to contain a core (5) with a mold cavity (6), wherein a surface of the mold cavity (6) is configured to form the rotor (2) in such a way that a longitudinal axis of the mold cavity (6) coincides with the longitudinal axis (15) of the rotor (2) formed in the mold cavity(6);

b. inserting the core (5) into the cavity (4); and c. pouring molten casting material into the mold cavity (6) through an inlet (7) of the core (5), and filling the mold cavity (6) completely or almost completely with casting material to form the rotor (2), wherein, the cavity (4) is held in a tilted position by tilting means (16) during step c, with the longitudinal axis of the mold cavity (6) tilted in relation to a gravitationally vertical direction and in relation to a gravitationally horizontal plane.

2. The method according to claim 1, wherein during step c the longitudinal axis of the mold cavity (6) is tilted in relation to a gravitationally horizontal plane over an angle of at least 5°.

3. The method according to claim 1, wherein during step c the longitudinal axis of the mold cavity (6) is tilted in relation to a gravitationally horizontal plane over an angle of at most 45°.

4. The method according to claim 1, wherein the cavity (4) is held in the tilted position during step c in such a way that in relation to the inlet (7) the mold cavity (6) extends upwards with respect to the gravitationally vertical direction.

5. The method according to claim 1, wherein during step c the angle over which the longitudinal axis of the mold cavity (6) is tilted in relation to a gravitationally vertical direction and in relation to a gravitationally horizontal plane is fixed by blocking means.

6. The method according to claim 1, wherein the cavity (4) is held in the aforementioned tilted position during step b.

7. The method according to claim 6, wherein the cavity (4) is formed during step a in the aforementioned tilted position in the green sand mold (3).

8. The method according to claim 1, wherein the green sand mold (3) with the cavity (4) is formed during step a by casting and pressing green sand on a mold plate (18), which the mold plate (18) is provided with a protruding pattern (19) configured to form the cavity (4) in the green sand mold (3).

9. The method according to claim 8, wherein the mold plate (18) comprises several flat plates tilted in relation to each other, at least one of these flat plates being provided with the protruding pattern (19) and tilted in relation to a gravitationally horizontal plane at an angle corresponding to the aforementioned tilted position.

10. The method according to claim 1, wherein the method is carried out on an automatic mold line.

11. The method according to claim 1, wherein before step c the molten casting material is filtered through a metal filter (17).

12. The method according to claim 1, wherein the method further comprises the step of positioning the green sand mold (3), whereby an upper side of the green sand mold (3) is held during step c by levelling means in a parallel position with a gravitationally horizontal plane.

13. A device for casting a rotor (2) with a longitudinal axis (15) for a compressor, vacuum pump and/or expander device, wherein the device has been configured to perform a method that comprises the following steps:

a. the formation of a green sand mold (3) with a cavity (4), wherein the cavity (4) is configured to contain a core (5) with a mold cavity (6), wherein a surface of the mold cavity (6) is configured to form the rotor (2) in such a way that a longitudinal axis of the mold cavity (6) coincides with the longitudinal axis (15) of the rotor (2) formed in the mold cavity(6);

b. inserting the core (5) into the cavity (4); and c. pouring molten casting material into the mold cavity (6) through an inlet (7) of the core (5), and filling the mold cavity (6) completely or almost completely with casting material to form the rotor (2), wherein the device comprises the green sand mold with the cavity and the device is provided with tilting means (16) configured to hold the cavity (4) in a tilted position during step c with the longitudinal axis of the mold cavity (6) in relation to a gravitationally vertical direction and in relation to a gravitationally horizontal plane.

14. The device according to claim 13, wherein the device is provided with blocking means in order to fix, during step c, the angle over which the longitudinal axis of the mold cavity (6) is tilted in relation to a gravitationally vertical direction and in relation to a gravitationally horizontal plane.

15. The device according to claim 13, wherein the device is configured to hold the cavity (4) in the aforementioned tilted position during step b and that the cavity (4) is formed during step a in the aforementioned tilted position in the green sand mold (3).

16. The device according to claim 13, wherein the device is configured in such a way that the green sand mold (3) with the cavity (4) is formed during step a by casting and pressing green sand on a mold plate (18), which the mold plate (18) is provided with a protruding pattern (19) configured to form the cavity (4) in the green sand mold (3).

17. The device according to claim 16, wherein the mold plate (18) comprises several flat plates tilted in relation to each other, at least one of these flat plates being provided with the protruding pattern (19) and tilted in relation to a gravitationally horizontal plane at an angle corresponding to the aforementioned tilted position.

18. The device according to claim 13, wherein the device is carried out as an automatic mold line.

19. The device according to claim 13, wherein the device is provided with a metal filter (17) configured to filter the molten casting material before step c.

20. The device according to claim 13, wherein the device is further configured to carry out a method comprising the step of positioning the green sand mold (3), wherein the device is provided with levelling means configured to hold an upper side of the green sand mold (3) during step c in a parallel position in relation to a gravitationally horizontal plane.

* * * * *